United States Patent [19]

Loomis et al.

[11] Patent Number: 4,499,860

[45] Date of Patent: Feb. 19, 1985

[54] FURNACE BUCKSTAY DESIGN

[75] Inventors: Robert W. Loomis, Tariffville; Carl W. Lawton, West Hartford, both of Conn.

[73] Assignee: Combustion Engineering, Inc., Windsor, Conn.

[21] Appl. No.: 529,308

[22] Filed: Sep. 6, 1983

[51] Int. Cl.[3] ..... F22B 37/24

[52] U.S. Cl. ..... 122/510; 122/6 A

[58] Field of Search ..... 122/6 A, 510, 493, 511

[56] References Cited

U.S. PATENT DOCUMENTS 3,373,721 3/1968 Sheikh ..... 122/510 X 3,809,018 5/1974 Pratt et al. ..... 122/510

4,059,075 11/1977 Ssinegurski et al. ..... 122/510 X

*Primary Examiner*—Edward G. Favors

*Attorney, Agent, or Firm*—William W. Habelt

[57] ABSTRACT

A buckstay arrangement for a furnace of a steam generator wherein the furnace tube walls (12) are supported by a plurality of independent buckstays (10). Each buckstay (10) comprises an elongated beam (40,70) disposed horizontally adjacent to the tube wall and interconnected therewith and having a cross-section defining therein a box-like section (30,30') whereby the polar moment of inertia of the buckstay (10) is greatly enhanced.

2 Claims, 4 Drawing Figures

FURNACE BUCKSTAY DESIGN

BACKGROUND OF THE INVENTION

The present invention relates to steam generating furnaces and, in particular, to a buckstay design for use in supporting the tube walls of the furnace.

Steam boiler plants generally have large furnaces which are commonly constructed of a number of water-cooled tubes welded in side-by-side arrangement to form gas tight tube banks forming the walls of the furnace. These tube walls are generally supported from the top of the structural framework of the steam generating plant. As the furnace approaches operating temperature, the furnace walls expand vertically downward as well as tending to dish in a horizontal direction. Additionally, the pressure excursions within the furnace, either an increase or a decrease in pressure within the furnace, cause a resultant additional flexing of the tube walls either inwardly or outwardly in a horizontal direction. Therefore, it has become customary and necessary to provide an arrangement of flanged girder beams, typically referred to as buckstays, that extend around the furnace to provide additional support to the furnace walls and prevent the dishing of the furnace walls in a horizontal direction as affected by pressure differential.

Typically, these buckstays are disposed in bands around the parimeter of the furnace tube walls at vertically spaced intervals throughout the height of the furnace wall. Horizontally, the buckstays on opposite walls of the furnace are interconnected through buckstay ties so that the reactions of one buckstay are resisted by the reactions of the buckstay on the opposing wall so as to counteract the pressure forces acting on the furnace walls. Vertically, it has been customary to provide vertical support members to interconnect each buckstay to its upper and lower neighbors with a connection that permits a sliding action which is required due to relative movement between the furnace tube walls to which each buckstay is connected and the buckstays themselves. As the furnace expands differentially in a vertical direction, each level of buckstays would move a different amount under the influence of the vertical elongation of the furnace tube walls. This relative vertical expansion between the furnace tube wall structure and the buckstays would produce a very high localized bending moment on the buckstays which has been customary to relieve with these vertical support members which extend between neighboring buckstays. Arrangements for relieving or preventing the bending moment of this type are disclosed in U.S. Pat. No. 3,461,847 and U.S. Pat. No. 3,861,360.

In such a buckstay arrangement utilizing vertically extending support members for interlinking the neighboring elevations of buckstays and absorbing the bending moment, the structural system is necessarily massive and also somewhat rigid. Therefore, the structural support system has a certain amount of inertia which must be overcome before the structural system can flex properly in response to pressure changes within the furnace and thereby absorb the pressure forces acting of the furnace walls. In the event that there is a sudden change in furnace pressure, an explosive or implosive load may be exerted on the furnace tube walls over a very short period of time. In such a system as described above wherein the bands of buckstays are interconnected in a vertical direction, it has been observed that the buckstay system may in some instances be incapable of responding to such a sudden change in furnace pressure without permanent damage to the buckstay system and/or the furnace wall.

Therefore, it is the object of the present invention to provide a buckstay design wherein the need for a vertical interconnection between adjacent bands of furnace buckstays is not necessary.

It is a further object of the invention to provide a buckstay having a cross-section which provides an inherently high polar high moment of inertia for resisting bending moments on the buckstay.

It is a further object of the invention to provide a buckstay having a cross-section which provides an inherent high polar moment of inertia to furnish lateral stability for buckling.

SUMMARY OF THE INVENTION

The buckstay of the present invention is characterized by a cross-section comprising a box-like section having a high polar moment of inertia.

In one embodiment of the present invention, the buckstay comprises an elongated channel beam having a horizontally disposed central member and first and second vertically disposed end members extending along the lateral edges of the central member so as to form an I-beam cross-section. The I-beam cross-section channel beam is disposed so as to have an upwardly facing channel and a downwardly facing channel on opposite sides of the central member. A first elongated plate member is mounted to the elongated channel beams so as to extend transversely across one of either the upwardly facing channel or the downwardly facing channel so as to form a box-like section within one channel of the I-beam corss-section. Preferably, a second elongated plate member is mounted to the elongated channel beams so as to extend transversely across the other of the upwardly facing or downwardly facing channels so as to form a second box-like section within the I-beam cross-section. The elongated plate members may be disposed so as to extend transversely across the channel from the outer tip of one end member to the outer tip of the other end member parallel to the central member thereby forming a rectangular box-like section within the channel beam cross-section. Alternatively, the elongated plate member may extend from the tip of one end plate inwardly at an acute angle to meet with and be secured to the central member of the channel beam thereby forming a triangular box-like section within the cross-section of the channel beam.

In an alternate embodiment, the buckstay of the present invention may comprise an elongated vertical end plate which is disposed along the furnace tube wall and an elongated U-shaped channel beam mounted to the vertical end plate so as to form a closed rectangular box-like section extending outward from the end plate.

The present invention provides a buckstay which has a cross-section having a high polar moment of inertia so that the buckstay itself may absorb bending moments generated by the expansion of the furnace and provides lateral stability. Therefore, there is no need to provide any vertical members to interconnect the spaced bands of buckstays surrounding the furnace wall as was required in the prior art.

BRIEF DESCRIPTION OF THE DRAWINGS

The present invention may be better understood and its novelty and unobviousness appreciated from the following description of the preferred embodiments shown in the accompanying drawings, wherein.

DESCRIPTION OF THE PREFERRED EMBODIMENT

Figure 1:
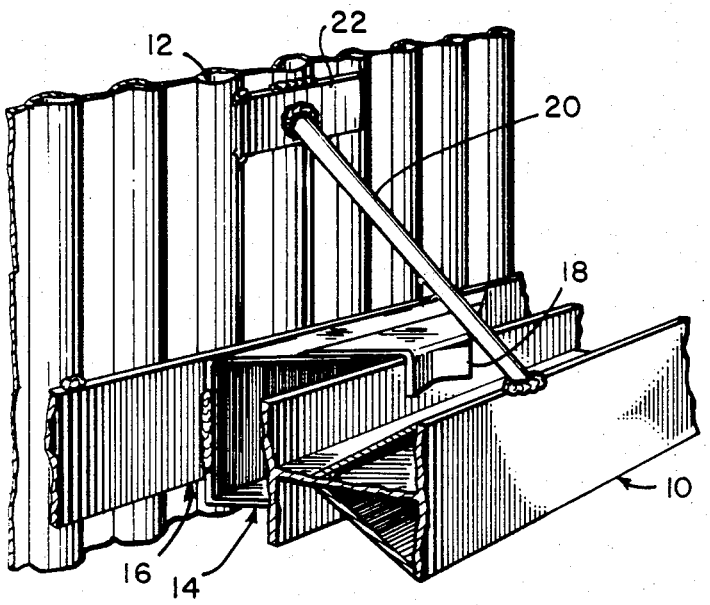
FIG. 1 is a perspective view showing one embodiment of the buckstay of the present invention supporting a section of the furnace tube wall.
Figure 2:
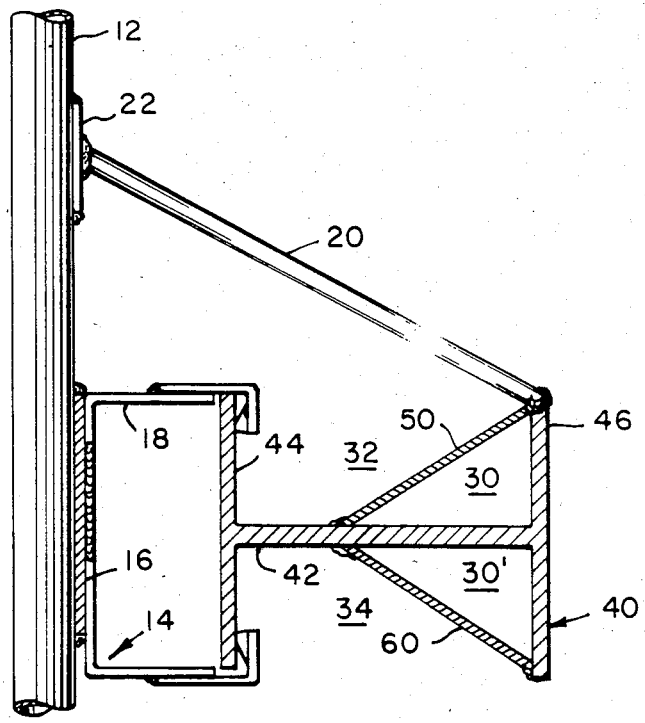
FIG. 2 is a side elevational view, partly in section, of the buckstay arrangement shown in FIG. 1.

Referring now to the drawings, and more particularly to FIGS. 1 and 2 thereof, there is shown therein a section of furnace tube wall 12 formed of a series of upright tubes disposed and welded together in side-by-side relationship to form a rectangular gas-tight enclosure surrounding the furnace combustion chamber. The tube walls of the furnace are supported against the pressure forces developed by positive or negative pressure within the combustion chamber by a plurality of buckstays 10 that extend horizontally around the furnace tube wall at a series of vertically spaced intervals. At each of the vertical spaced intervals, a band of buckstays comprised of one buckstay per wall surround the furnace tube wall enclosure. The buckstays disposed along opposite walls are linked together at their ends by buckstay ties, not shown, so that the buckstays along opposite walls work together to resist the pressure forces acting on the furnace tube wall.

The furnace tube wall 12 is linked to each buckstay 10 for support therefrom by means of brackets 14. There are one or more brackets 14 positioned between each buckstay and an adjacent section of the furnace tube wall 12 to provide support of the tube wall from the buckstay 10 to preclude deflection or dishing of the furnace tube walls caused by the excessive positive or negative pressure within the furnace but at the same time permit sliding movement of the buckstay ten within the bracket 14. Each bracket comprises a tie plate 16 welded horizontally to the surface of the furnace tube wall 12 and a U-shaped support bracket 18 welded to the tie plate 16 and extending horizontally outward therefrom to receive and engage the buckstay 10 in such manner as to permit sliding movement between the buckstay 10 and the bracket 18.

Additionally, each buckstay 10 is supported at one or more locations by means of a support rod 20 which extends vertically upward from the outer edge of the buckstay 10 at an acute angle towards the furnace tube wall 12 to meet a mounting plate 22 which is welded to the exterior of the furnace tube wall 12. The support rod 20 is welded between the tie plate 22 and the upper outer edge of the buckstay 10 to provide a means for supporting the dead weight of the buckstay 10 from the furnace wall without placing an excessive bending moment on the bracket 14.

In accordance with the present invention, each buckstay 10 of the present invention has a cross-section, at least in part, comprising a box-like section 30 or 30′ having a high polar moment of intertia. This box-like section 30 or 30′ may be triangular in shape as illustrated in the embodiment shown in FIG. 2 or rectangular in shape as shown in the embodiment depicted in FIGS. 3 and 4.

In the embodiment of the buckstay of the present invention shown in FIGS. 1 and 2, the buckstay comprises an elongated channel beam 40 having a horizontally disposed central member 42 and first and second vertically disposed end members 44 and 46 extending along the lateral edges of the central member 42 so as to form an I-beam cross-section. The vertically disposed end member 44 of the channel beam 40 adjacent the furnace tube wall 12 is enclosed in the mounting bracket 18 attached to the tube wall 12 through the tie plate 16 to interconnect the tube wall 12 with the buckstay 10. With the I-beam 40 disposed with its central member 42 horizontal and its end members 44 and 46 vertical, an upwardly facing channel 32 is formed above the central member 42 of the beam 40 between the end plates 44 and 46 thereof and a downwardly facing channel 34 is formed beneath the central member 42 of the channel beam 40 between the end plates 44 and 46 thereof. Additionally, a support rod 20 is interconnected between the mounting plate 22 and the upper edge of the outer end member 46 of the channel beam 40 at one or more locations along the channel beam 40 to support the dead weight of the buckstay 10.

In accordance with the present invention, an anti-buckling member 50,60 is mounted to the elongated channel beam 40 so as to extend transversely across one of either the upwardly facing channel 32 or the downwardly facing channel 34 of the elongated channel beam 40 so as to form a box-like section 30,30′ within the I-beam cross-section of elongated channel beam 40. As shown in FIG. 2, preferably comprises a first elongated plate member 50 disposed to extend transversely from the upper edge of the outward vertical member 46 of the beam 40 inwardly at an acute angle to meet the central member 42 of the channel beam 40. The elongated plate member 50 is welded to the outward end member 46 of the beam 50 along its interface with the upper edge of the vertical end member 46 and also to the central member 42 of the beam 40 at its interface therewith to form a triangular box-like section 30. Additionally, a second elongated plate member 60 may be disposed so as to extend transversely from the lower edge of the outer end member 46 inwardly at an acute angle to meet the central member 42 with the beam 40. The second plate member 60 is welded at its respective interfaces with the outer end member 46 and the central member 42 of the beam 40 to form a second triangular box-like section to further enhance the polar moment of inertia of the buckstay 10.

Figure 3:
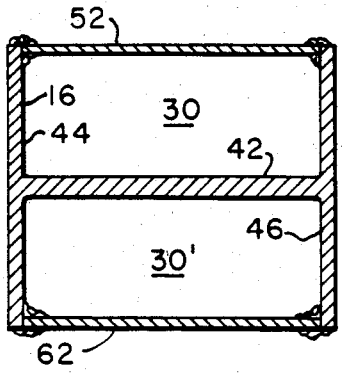
FIG. 3 is a cross-sectional view showing an alternate embodiment of the buckstay of the present invention.

Alternatively, as shown in FIG. 3, the anti-buckling member mounted to the channel beam to form the desired box-like section may comprise an elongated plate member 52 disposed so as to extend transversely across the upwardly facing channel 34 parallel to the central member 42 between the upper edges of the vertical members 44 and 46 thereby forming a rectangular box-like section 30. Additionally, a second elongated plate member 62 may be disposed so as to extend transversely across the downwardly facing channel 34 again parallel to the central member 42 between the lower end of the vertical end members 44 and 46 of the channel beam 40 to form a second rectangular box-like section 30′. In each case, the plate members 52 and 62 are welded to the end members 44 and 46 of the channel beam 40 at their interfaces therewith. Of course, suitable slots would have to be cut in the plate members 52 and 62 at appropriate locations to receive the ends of the U-shaped mounting bracket 18 into which the inward end member 44 of the channel beam 40 is inserted to link the buckstay 10 to the tube wall 12.

Figure 4:
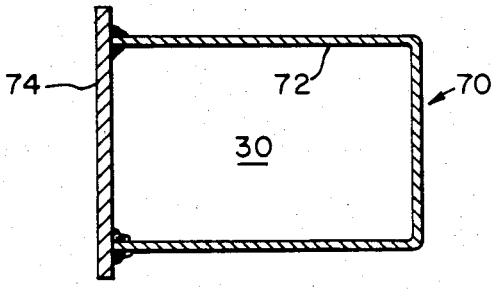
FIG. 4 is a cross-sectional view showing yet another alternate embodiment of the buckstay of the present invention.

In an alternate embodiment of the present invention, as shown in FIG. 4, the buckstay 10 comprises a box beam 70 formed of an elongated vertical end plate 74 which is disposed along the furnace tube wall and inserted into the mounting bracket 18 for linking the buckstay 10 with the furnace tube wall 12 and an elongated U-shaped channel beam 72 mounted to the vertical end plate 74 so as to extend outwardly therefrom to form a closed box-like section 30 disposed outwardly with respect to the furnace wall 12 of the end plate 74. Again, one or more support rods 20 would be welded between mounting plates 22 on the furnace tube wall 12 to the outward and upward edge of the U-shaped channel beam 72 to support the dead weight of the box beam 70.

The anti-buckling members 50, 60, 52 and 62 have been described as being elongated plate members. It is to be understood that it is not necessary that the plate members 50, 60, 52 and 62 be formed of a single elongated plate but may also, within the scope of the invention, be formed of a plurality of shortened plate members disposed within the channel beam 40 at spaced intervals with a gap therebetween and still provide sufficient increase in the polar moment of inertia of the buckstay 10 to resist any bending moment imposed upon the buckstay 10 by positive or negative pressures within the combustion chamber enclosed by the furnace tube wall 12. Similarly, it is contemplated that the elongated channel beam 72 in the box beam 70 embodiment of the present invention may also be formed of a plurality of shortened U-shaped channel members welded to the end plate 74 at spaced intervals along the length thereof with appropriate gaps therebetween while still providing sufficient polar moment of inertia to withstand the bending moments imposed upon the buckstay 10.

Although the present invention has been described with reference to the particular embodiment shown in the attached drawings, it is understood that those skilled in the art may make various changes and modifications to the embodiments shown in the drawings without departing from the true spirit of the present invention. Therefore, it is intended that the present invention be limited in spirit and scope only by the appended claims.

We claim:

1. A rectangular furnace comprised of vertical walls formed by a series of laterally adjacent upright water-cooled tubes, and a furnace wall support system formed of a plurality of horizontally disposed buckstays extending transversely around the vertical walls of the furnace in vertically spaced arrangement from which the furnace walls are supported, characterized in that each of said plurality of buckstay beams comprises:

a. an elongated channel beam having a horizontally disposed central member and first and second vertically disposed end members extending along the lateral edges of the central member so as to form an I-beam cross-section having an upwardly facing channel and a downwardly facing channel on opposite sides of the central member, the second vertically disposed end member spaced further away from the furnace wall than the first vertically disposed end member is spaced away from the furnace wall; and b. an anti-bucking member means associated with said channel beam for forming therewith a box-like section having a high polar moment of intertia, said anti buckling member means comprising a first elongated plate member mounted to said elongated channel beam so as to extend transversely from the second vertically disposed end member across one of the upwardly facing or the downwardly facing channels so as to form a first box-like section within the I-beam cross-section of said elongated channel beam.

2. A furnace as recited in claim 1 wherein said anti-buckling member means of each said plurality of buckstays further comprises a second elongated late member mounted to said elongated channel beam so as to extend transversely from the second vertically disposed end member across the other of the upwardly facing or downwardly facing channel so as to form a second box-like section within the I-beam cross-section of said elongated channel beam on the opposite side of the central member from said first box-like section.

* * * * *